US005367326A

United States Patent [19]

Pond et al.

[11] Patent Number: 5,367,326

[45] Date of Patent: Nov. 22, 1994

[54] INK JET PRINTER WITH SELECTIVE NOZZLE PRIMING AND CLEANING

[75] Inventors: Stephen F. Pond, Pittsford; David G. Anderson, Ontario, both of N.Y.

[73] Assignee: Xerox Corporation, Stamford, Conn.

[21] Appl. No.: 955,766

[22] Filed: Oct. 2, 1992

[51] Int. Cl.[5] ..... B41J 2/165

[52] U.S. Cl. ..... 347/22

[58] Field of Search ..... 346/140 R, 75; 400/126

[56] References Cited

U.S. PATENT DOCUMENTS

| | | | |
|---|---|---|---|
| Re. 32,572 | 1/1988 | Hawkins et al. | 156/626 |
| 4,463,359 | 7/1984 | Ayata et al. | 346/1.1 |
| 4,774,530 | 9/1988 | Hawkins | 346/140 R |
| 4,829,324 | 5/1989 | Drake et al. | 346/140 R |
| 4,878,992 | 11/1989 | Campanelli | 156/633 |
| 4,947,191 | 8/1990 | Nozawa et al. | 346/140 R |
| 5,055,856 | 10/1991 | Tomii et al. | 346/1.1 |
| 5,055,861 | 10/1991 | Murayama et al. | 346/140 R |
| 5,057,853 | 10/1991 | Fisher | 346/140 R |
| 5,068,006 | 11/1991 | Fisher | 156/633 |

*Primary Examiner*—Benjamin R. Fuller

*Assistant Examiner*—N. Le

*Attorney, Agent, or Firm*—Robert A. Chittum

[57] ABSTRACT

A pagewidth ink jet printer has a fixed, pagewidth printhead with a linear array of nozzles extending along its length and a movable cleaning and priming station adapted for movement parallel to and along the array of printhead nozzles. The cleaning and priming station has a vacuum conduit connected to a vacuum source and has an open end which confronts at least one nozzle at the nozzle array. The array of nozzles reside in a planar printhead nozzle face which has a ledge spaced from and parallel to the linear array of nozzles. The ledge extends from one edge of the nozzle face, and has a planar surface parallel to the nozzle face and a predetermined distance therefrom. The cleaning and priming station is slidingly moved in contact with the ledge surface, so that the vacuum conduit open end is maintained fixed distance from the nozzle face. The station may be moved to selected nozzles and the vacuum from the vacuum source may be varied for cleaning or priming.

14 Claims, 4 Drawing Sheets

INK JET PRINTER WITH SELECTIVE NOZZLE PRIMING AND CLEANING

BACKGROUND OF THE INVENTION

The present invention relates to ink jet printers having printhead priming and cleaning means and, more particularly, to priming and cleaning devices for selective priming and cleaning of ink jet printhead nozzles without contact therewith.

Ink jet printers usually include one or more linear arrays of nozzles contained on a planar surface of a printhead. Droplets of ink are ejected from the nozzles and directed toward a recording medium (e.g., paper) to print images thereon. Droplet ejection can be effected by, for example, piezoelectric transducers or thermal transducers (e.g., resistive heating elements) as is well known in the art. The nozzles are formed, for example, by etching a plurality of channels in one surface of a first silicon wafer, which is then adhesively bonded to a surface of another silicon wafer having sets of selectively addressable heating elements thereon. Each channel contains a heater element. The bonded silicon wafers are then diced along a line perpendicular to and intersecting the channels to form a planar nozzle face of the printhead, which contains a linear array of nozzles (corresponding in number to the number of channels formed in the first wafer). See, for example, U.S. Pat. Nos. 4,878,992 to Campanelli; Re. 32,572 to Hawkins et al; and 4,774,530 to Hawkins, the disclosures of which are incorporated herein by reference. Pagewidth ink jet printheads may be fabricated by assembling fully functional printhead subunits on a structural bar in one of two basic ways; viz., staggered on opposite sides of the structural bar or abutted in an end-to-end fashion on one side of the structural bar. See, for example, U.S. Pat. Nos. 4,463,359 to Ayata et al. and 4,829,324 to Drake et al., respectively, for staggered opposite side and abutted end-to-end pagewidth printheads.

In order to eject droplets having a consistent size and ejection direction, the nozzle face of the printhead which contains the nozzles must be maintained free of any contamination, scuffs, or scratches. Any scratches or contamination on the nozzle face of the printhead, especially in the vicinity of a nozzle, can interfere with the formation of an ink meniscus at that nozzle, causing drop misdirection. Additionally, the nozzle containing surface or face of the printhead is frequently treated with a coating which is non-wettable by the ink. The non-wettable coating prevents ink from adhering to the planar, nozzle-containing surface of the printhead, which adhered ink can also interfere with the ejection of new droplets from the nozzles. Contact cleaning of nozzle-containing surfaces having such non-wettable coatings tends to frictionally wear the coating off, so that non-contact cleaning is preferred.

The processes which make these printheads result in nozzles having sharp edges. These sharp edges assist in the meniscus formation process, but also increase the probability of contamination in the nozzles, if cleaned by wiper blades, because these sharp edges tend to shear small pieces from wiping blades which then collect in the nozzles.

Air can occasionally be collected or ingested into the channels of the printhead which supply ink to the nozzles during operation of the printhead, disrupting the operation of those nozzles. This disruption is typically removed by priming. Priming can also be used to remove dirt or dried ink from the printhead nozzles. One source of dirt is because of the close proximity of the printhead nozzle face to the paper, which releases dust and particles, as well as due to the presence of airborne dust and other particles. Additionally, as discussed above, when wiping blades are used to wipe contaminants and residual ink from the planar nozzle face of the printhead, the sharp edges of the nozzles tend to wear or slice small pieces from the wiping blades, which further clog the nozzles.

A number of procedures are known for priming printheads with fresh ink. Pressure can be applied to the ink supply to force ink out through the nozzles. Alternatively, suction can be applied to all of the nozzles in the printhead to draw ink simultaneously through all the channels. As another alternative, suction can be applied to a lesser number of nozzles (i.e., not all of the nozzles) at a time through one or more tubes or small diameter hoses.

Copending U.S. application Ser. No. 07/777,043, filed Oct. 16, 1992, entitled "Movable Ink Jet Priming Station" to Fisher et al. and commonly assigned to the assignee of the present invention, discloses that positioning a small diameter tube closely adjacent, yet spaced away from, a nozzle-containing front face of the printhead removes more dirt by drawing in air located adjacent to the front face, as well as ink located in the channels. Accordingly, as compared to a single small diameter tube, a cleaning device which applies vacuum to all nozzles at the same time does not apply a force which is sufficient to adequately remove dirt from the nozzles. Additionally, much of the vacuum is lost through the large sealing surface of priming members which suction all nozzles at once. Furthermore, priming stations which suction all nozzles at once tend to leave ink on the front face of the printheads, which ink must be removed, for example, by wiping blades. As discussed above, minute pieces of blade material are cut from the wiping blades by the nozzles, contributing to recontamination of the nozzles.

U.S. Pat. No. 4,947,191 to Nozawa et al discloses an ink jet recording apparatus having an ink jet head provided with plural discharge openings and a partial capping member for covering a part of the plural discharge openings and applying suction only to the covered part of the plural discharge openings. The partial capping member is provided on a belt which is moved across the nozzles of the printhead to selectively locate the partial capping member adjacent to a small number of nozzles. The capping member of Nozawa et al contacts the printhead face along the array of nozzles and is moved along the array of nozzles. The capping member of Nozawa et al could scratch the printhead nozzle face, as well as wear away any coating material thereon. The present invention differs from Nozawa et al. at least in that the present invention provides a priming station which does not contact the areas of the printhead containing the nozzles and yet controls the spacing or gap between the priming and cleaning orifice and a pagewidth printhead over the entire length thereof.

U.S. Pat. No. 5,055,856 to Tomii et al. discloses an ink capping device for an ink jet printer which includes a cap for sealing the ink outlet portion of an ink jet printhead, a suction device for maintaining a proper ink level within the printhead, and a valve to regulate pressure within the printhead. The cap can be supported by and urged towards the printhead by a support member to compensate for displacement of the printhead with respect to the support member and maintain uniform pressure distribution at a contact surface between the cap and the printhead. By applying successive suction operations to the cap, in which the second suction operation is shorter than the first, the ink meniscus level is maintained at a proper level for printing despite extended exposure of the printhead to high temperatures. Tomii et al. does not disclose noncontact method of priming with controlled spacing between a suction nozzle and the nozzle face of a pagewidth printhead along the entire length of the printhead.

U.S. Pat. No. 4,878,992 to Campanelli discloses an ink jet printhead fabrication process wherein a plurality of printheads are produced from two mated substrates by two dicing operations. One dicing operation produces the nozzle face for each of a plurality of printheads and optionally produces the nozzles. A second dicing operation with a standard dicing blade severs the mated substrates into separate printheads. The dicing operation which produces the nozzle face is preferably conducted in a two-step operation. A first cut makes the nozzle face, but does not sever the two mated substrates- A second dicing cut severs the two substrates, but does so in a manner that prevents contact by the dicing blade with the nozzle face. Campanelli discloses a printhead having a ledge, but does not indicate a use for the ledge. The present invention uses such a ledge to control the spacing of a priming station therefrom.

U.S. Pat. Nos. 5,057,853 and 5,068,006, both to Fisher, disclose thermal ink jet printheads and method of batch production thereof. These patents disclose printheads with a stepped nozzle face, but have a photopatterned thick film layer sandwiched between the channel wafer and heater wafers, so that dicing operations to separate the aligned and bonded wafers into separate printheads do not require dicing of the thick film layer in the vicinity of the nozzles, thereby preventing formation of burrs which affect droplet directionality. These patents include embodiments with ledges on the nozzle face, but do not recognize, teach, or disclose a use for the ledges. To the contrary, the ledges of Fisher are impediments to blade cleaning of carriage type, reciprocable printheads, unless removed to provide planar access to the nozzle containing faces.

OBJECTS AND SUMMARY OF THE INVENTION

It is an object of the present invention to provide a station for cleaning and priming a small number of nozzles of pagewidth ink jet printheads, while providing a high vacuum capable of removing air and contaminants from selected nozzles.

In the present invention, a pagewidth ink jet printer has a fixed pagewidth printhead with an extended linear array of nozzles in the printhead nozzle face. The printhead and nozzle have a length equal to or greater than the width of a recording medium, which is moved therepast at a constant velocity in a direction perpendicular to the array of nozzles. The pagewidth printhead is preferably assembled from fully functional printhead subunits mounted on a structural bar and abutted together in an end-to-end fashion by means well known in the art. The subunits are mounted on the structural bar, so that the nozzle face of each subunit is coplanar with the nozzle faces of the other subunits making up the pagewidth printhead. Generally, at least two dicing cuts are required to produce the printhead lead subunit nozzle faces, when the aligned and bonded channel wafer and heating element wafer are separated into individual printhead subunits.

In one embodiment, the printheads are separated by one dicing operation which places a groove in the heating element wafer of the bonded wafer pair which is parallel to the desired location of the nozzles and nozzle faces containing the nozzles. A second parallel dicing operation is slightly offset, but intersects the groove formed in the heating element wafer, so that the second dicing operation forms the printhead subunit nozzle face, but forms a ledge below the nozzles. The ledge has a surface parallel to the nozzle face which is raised therefrom a predetermined, very accurate distance from the portion of the nozzle face having the nozzles. When the printhead subunits are fixedly mounted on the structural bar, either the ledge surface or the portion of the nozzle faces with the nozzles may be assembled thereon coplanar with an edge of the structural bar. A movable cleaning and priming station is adapted for movement parallel to and in sliding engagement with the printhead ledge surface or the combined printhead ledge surface and structural bar surface, if they are coplanar. The cleaning and priming station has a vacuum conduit connected at one end to a variable vacuum source and the opposing end of the conduit serves as a vacuum port which is located and maintained a fixed distance from the printhead nozzle face. The cleaning and priming station may be moved along the entire length of the pagewidth printhead but the vacuum source is selectively applied to the conduit when cleaning or priming of particular nozzles are desired- For one level of vacuum, the confronting nozzle face portion is cleaned, and for another higher level of vacuum, the selected nozzles are primed. This arrangement protects the necessary but fragile, non-wetting, nozzle-face surface coating by always using a non-contact cleaning and priming method. Since this spacing between the vacuum port and the nozzle face must be controlled to a nominal gap of less than 0.125 mm, such a tight tolerance would ordinarily cause an economic impact. However, the ledge and ledge surface provide excellent tolerance control because the dicing of silicon can be very accurately controlled.

In the preferred embodiment, the cleaning and priming station comprises a carriage which moves, for example, on guide rails by a motor driven pulley and cable system. A support member is mounted on the carriage for relative movement perpendicular to the carriage movement direction and resiliently urged by a spring into contact with the printhead ledge surface. The support member may be in rolling contact with the printhead ledge surface by, for example, the use of roller bearings or cylindrical bearings or may be in sliding contact therewith. If in sliding contact, the support member or its surface is a material which provides minimum frictional forces with the silicon ledge and, therefore, provides smooth sliding movement of the support member against the silicon ledge or combined silicon ledge and structural bar edge.

In one embodiment, the printer controller causes the nozzle face to be cleaned between each sheet of recording medium that is printed, and may selectively prime one or a few adjacent nozzles by stored algorithm in the controller or other automatic or manual indication that certain nozzles require priming.

A more complete understanding of the present invention can be obtained by considering the following detailed description in conjunction with the accompanying drawings, wherein like parts have like index numerals.

DESCRIPTION OF THE PREFERRED EMBODIMENT

Figure 1:
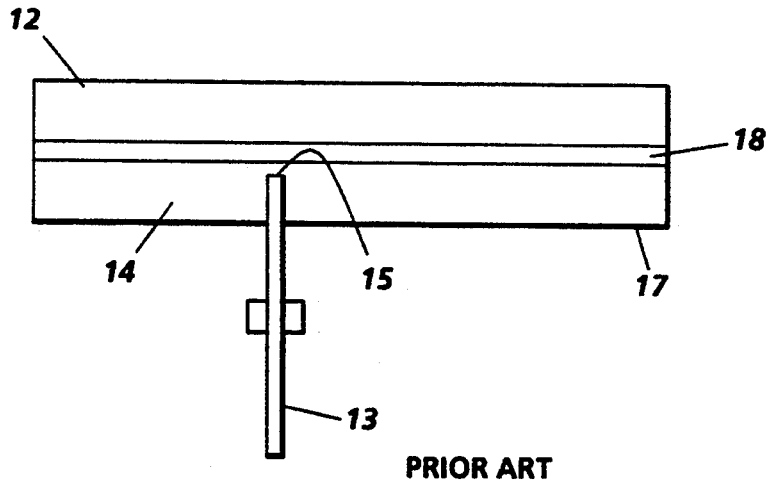
FIG. 1 is a schematic side view of a bonded pair of wafers showing the first of two dicing cuts producing the nozzle faces of a plurality of printhead subunits.
Figure 2:
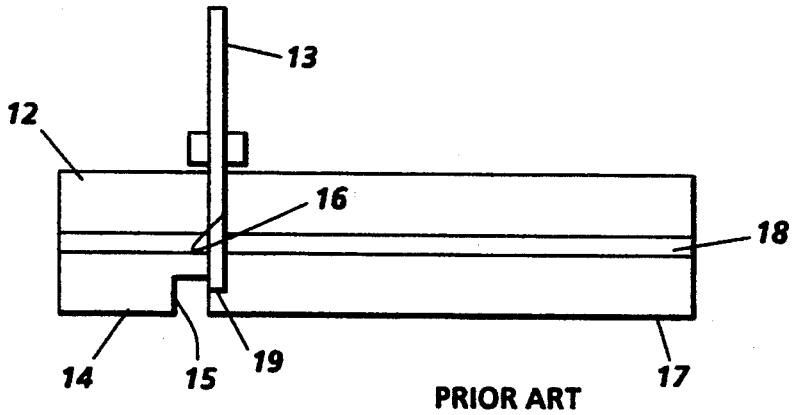
FIG. 2 is a schematic side view of a bonded pair of wafers showing the second of two dicing cuts producing the nozzles faces of a plurality of printhead subunits.
Figure 3:
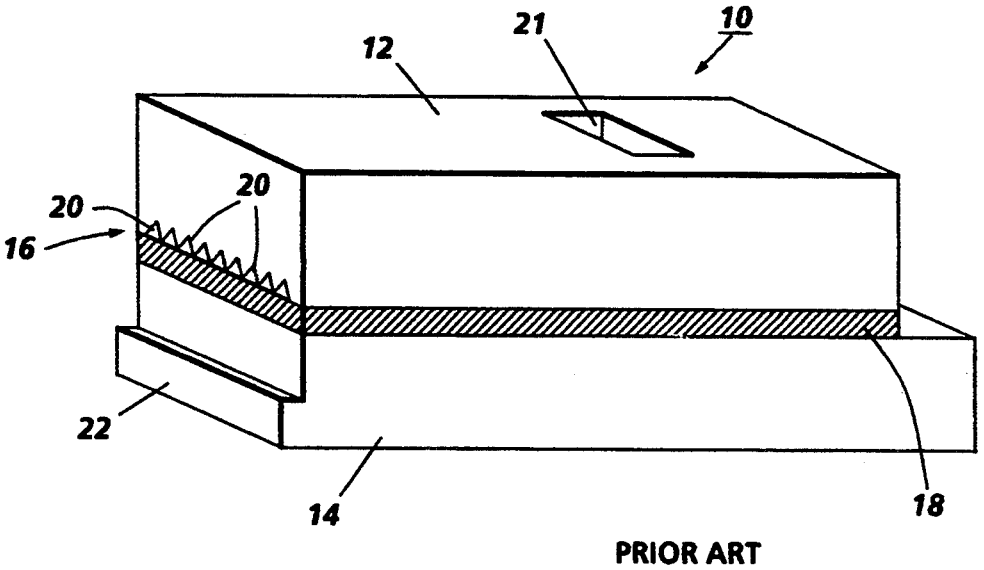
FIG. 3 is an isometric view of an individual printhead subunit showing the nozzle face ledge produced by the dicing operation depicted in FIGS. 1 and 2.

Referring to FIGS. 1 and 2, a channel wafer 12, having a plurality of sets of etched parallel channel grooves and associated etched-through reservoirs (neither shown), is aligned and bonded to a heater wafer 14 having a plurality of sets of arrays of heating elements and associated addressing electrodes, drivers and logic circuitry (none shown) formed on one surface thereof with a patterned thick film layer 18, which places the heating elements in pits (not shown), and provides the ink flow bypass (not shown) to place the sets of channel grooves into communication with the reservoirs. As is well known in the art, a heating element is positioned in each channel groove. Dicing saw 13 is shown in FIG. 1 cutting a kerf or notch 15 in the heater wafer in a predetermined location perpendicular to the arrays of heating elements, but in the heater wafer surface 17 opposite the surface with the heating elements and thick film layer. In FIG. 2, the dicing saw 13 is shown cutting a kerf or notch 19 parallel to the notch 15 and offset therefrom. The notch 19 intersects notch 15 and the sets of channel grooves, producing nozzle face 16 with nozzles 20 therein and the ledge 22, better shown in FIG. 3. After the dicing operation is completed in accordance with the above-mentioned dicing steps, a plurality of individual fully functional printheads are obtained. For details of the dicing process refer to U.S. Pat. No. 4,878,992 to Campanelli and U.S. Pat. Nos. 5,057,853 and 5,068,006 both to Fisher, all three of which are incorporated herein by reference. These printheads may be used singly as printheads in a translating carriage type printer or printhead subunits abutted end-to-end on a structural bar for use in a pagewidth printer. In FIG. 3, an enlarged schematic isometric view of a single printhead subunit 10 is depicted. This printhead subunit comprises aligned and bonded wafer portions of the wafer pair, referred to as channel plate 12 and heater plate 14 with the patterned thick film layer 18 sandwiched therebetween, such as, for example, polyimide, and shows the nozzle face ledge 22. The reservoir (not shown) has an open bottom 21 which serves as an ink inlet when fully assembled.

Figure 4:
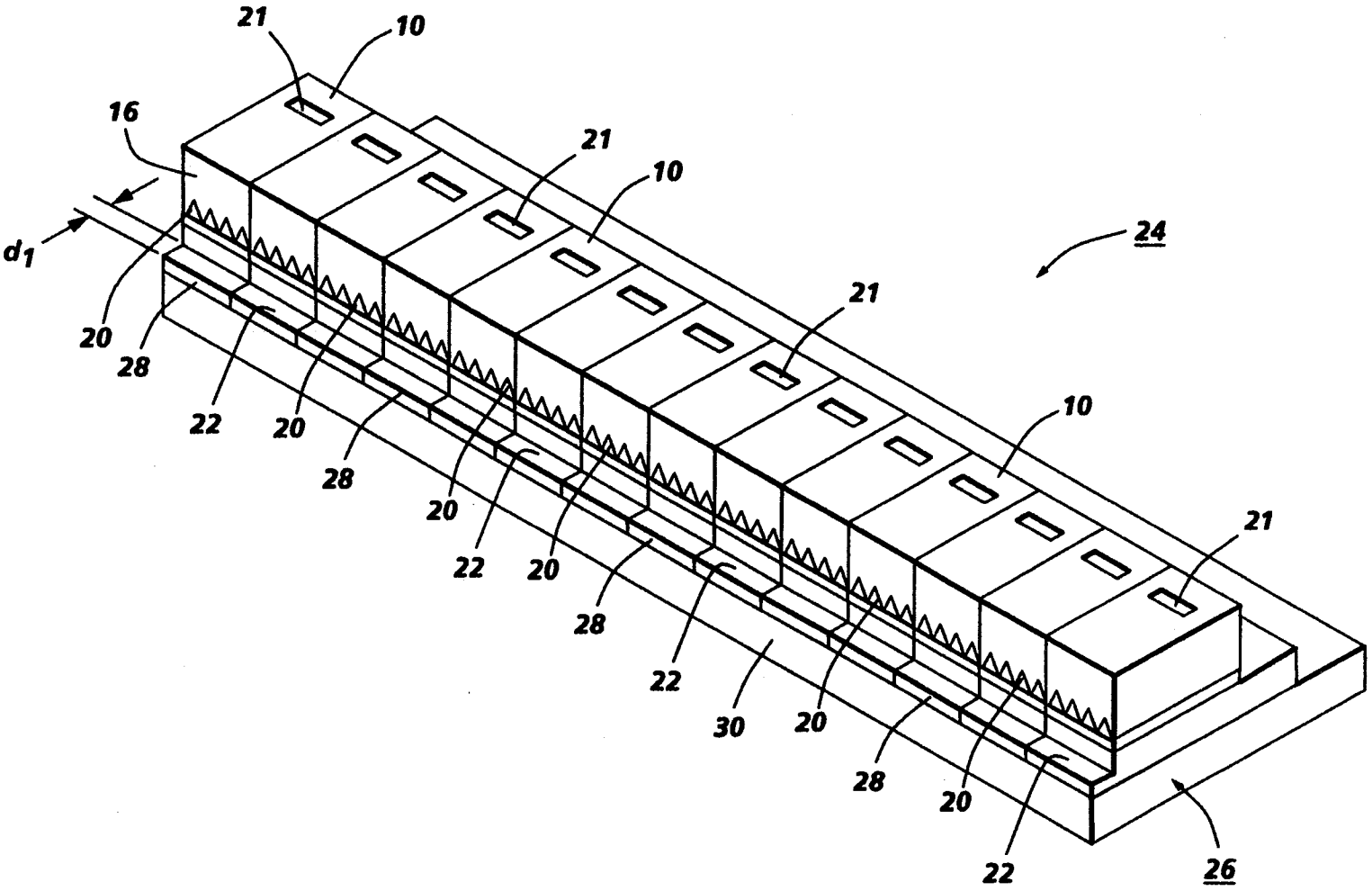
FIG. 4 is a schematic isometric view of a pagewidth printhead showing ledge used to space a movable priming and cleaning station from the printhead nozzle face.

A schematic isometric view of a pagewidth printhead 24, assembled from printhead subunits 10 placed end-to-end on a structural bar 26, is shown in FIG. 4. Each ledge surface 28 of ledges 22 are coplanar with structural bar edge surface 30. The distance $d_1$ delineates the dimension of the ledge surface from the nozzle face 16 and, hence, the nozzles 20. Typically, $d_1$ is between 0.05 and 0.125 mm and preferably about 0.1 mm. Nozzle face 16 is coated with a material that is non-wetting to the ink. For water based ink, a coating such as disclosed in U.S. Pat. No. 5,136,310 to Drews may be used to control the wetting characteristics of the nozzle face or any other coating material suitable for use to control the ink wetting of the nozzle face.

Figure 5:
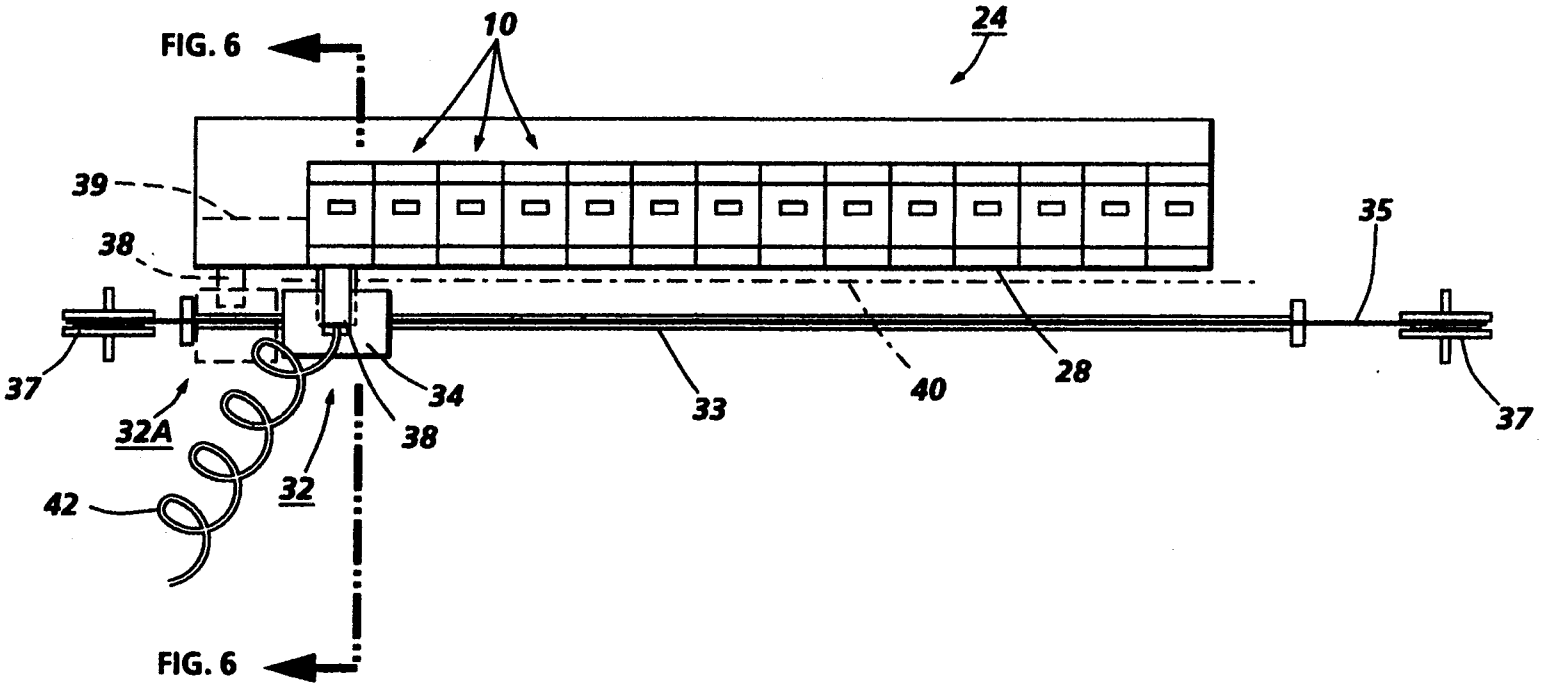
FIG. 5 is a schematic plan view of the pagewidth printhead and priming and cleaning station.
Figure 6:
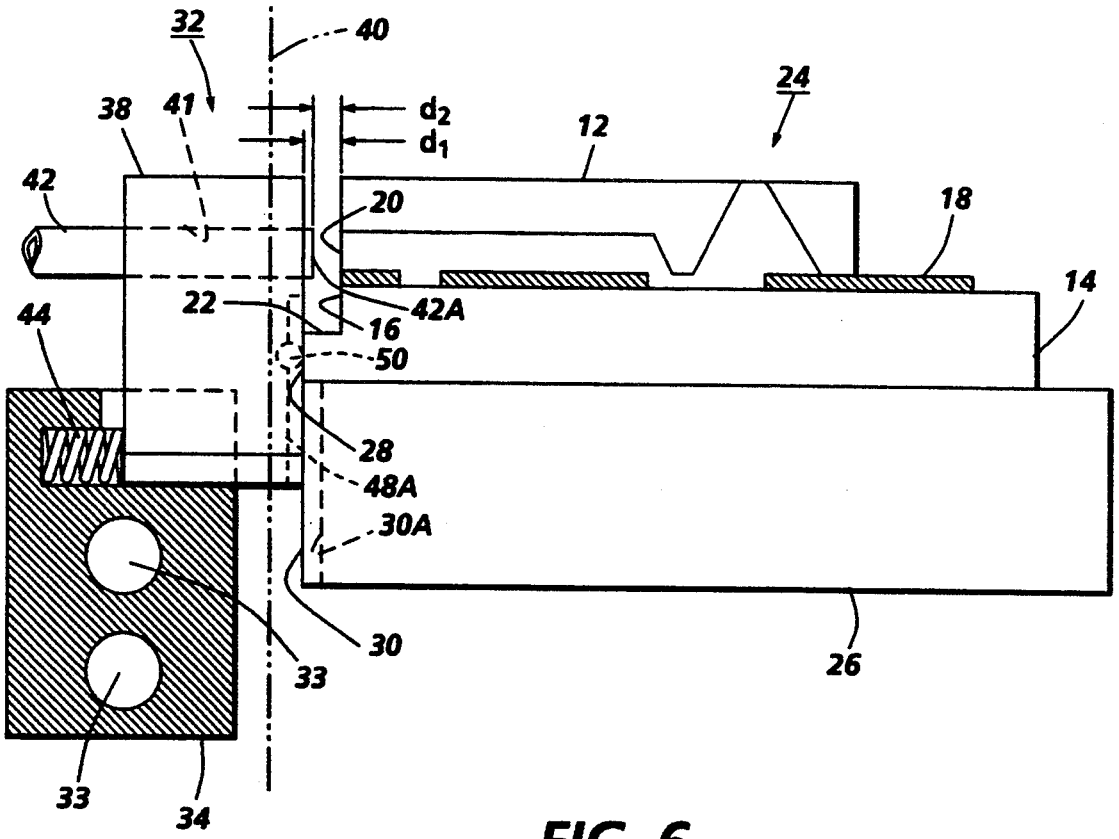
FIG. 6 is a cross-sectional view of the pagewidth printhead and priming and cleaning station as viewed along view line 6—6 of FIG. 5.
Figure 7:
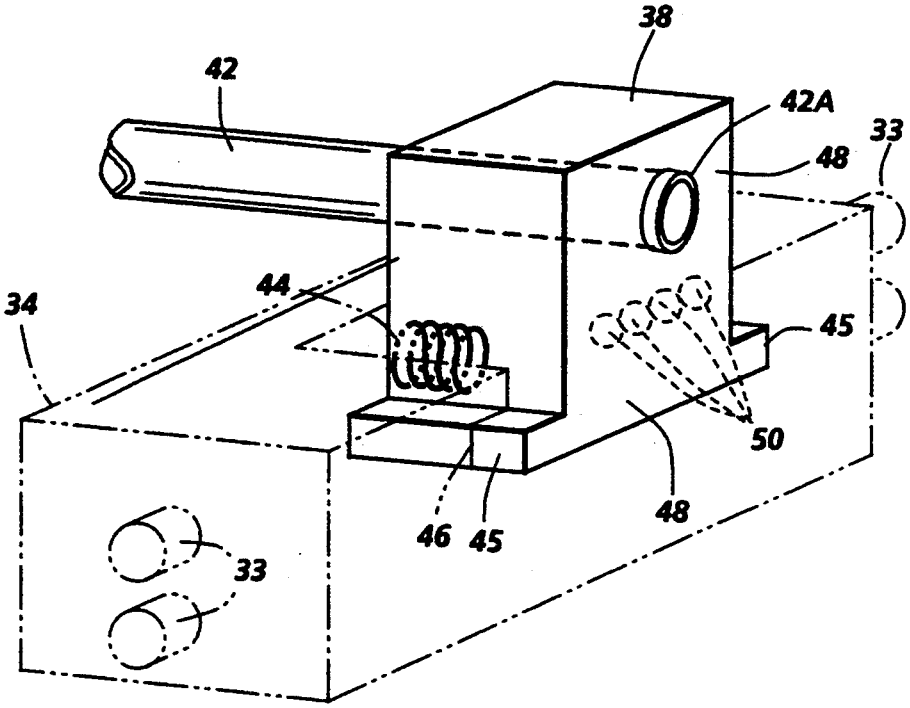
FIG. 7 is a partially shown isometric view of the slidable support member of the priming and cleaning station which is resiliently urged into contact with the nozzle face ledge of the pagewidth printhead.

Referring to FIG. 5, a plan view of the fixed pagewidth printhead 24 of FIG. 4 is shown, together with the priming and cleaning station 32 of the present invention. The remainder of the printer has been omitted for clarity, since it is of typical construction and does not form a part of the invention. The priming and cleaning station comprises a movable carriage 34, which resides on guide rails 33 and is reciprocated back and forth by cable 35 and pulleys 37 driven by a reversible motor (not shown). Support member 38 is slidably mounted for movement relative to the carriage in a direction perpendicular to the carriage direction of movement. The guide rails are spaced behind and parallel to the printing plane 40 and ledge surface 28, so that the guide rails do not cause interference with the recording medium's path of movement past the printhead. The support member is resiliently urged into contact with the ledge surface 28 or the combined ledge surface and from edge surface 30 of the structural bar 26 by, for example, a spring 44 (see FIG. 6). To provide clearance of the full recording medium width, the structural bar is preferably extended in at least one direction to permit the priming and cleaning station 32 to be moved to one side or either side as shown in dashed line at 32A. A dummy printhead subunit (not shown) or a dummy ledge 39, shown in dashed line, assures smooth movement of the priming and cleaning station from the position out of the printing zone to a position anywhere along the nozzle face of the printhead. A vacuum source (not shown), with means (not shown) to reduce the suction by the vacuum source, is connected to one end of vacuum conduit 42 which serves as a vacuum port. The opposite end of conduit 42 is referred to as a vacuum port 42A and is mounted on the support member 38, so that this end of the conduit is positioned a predetermined distance $d_2$ from the nozzle face 16, shown in FIG. 6, an enlarged, schematic, cross-sectional view of the printhead 24 and priming and cleaning station 32. The cross-sectional view is taken along view line 6—6 in FIG. 5. In the embodiment shown in FIG. 6, the vacuum conduit may be fixedly mounted in a hole 41 in the support member 38. Although the vacuum port is shown closer in distance ($d_2$) than the ledge surface distance $d_1$ from the nozzle face, $d_2$ may equal $d_1$. As is well known in the industry, the vacuum source has an intermediate waste ink and debris collector (not shown) located between the vacuum source and the priming and cleaning station 32. In an alternate embodiment, the structural bar surface 30 may be recessed from the ledge surface 28 as shown by dashed line 30A. Referring also to FIG. 7, an isometric view of the support member 38 is shown, with the carriage shown in dashed line. The support member has extension 45 extending from opposite sides of the support member in a direction parallel to the carriage guide rails 33. These support member extensions are slidably captured in grooves 46 formed in the carriage 34 to restrict the movement of the support member to that of movement towards and away from the printhead ledge 22 (see FIG. 6). The confronting surface 48 of the support member 38 is coated or partially coated with a material such as Teflon® to ensure a smooth, low friction sliding contact with the printhead ledge 22. Alternatively, the entire support member may be made of a low friction material that is compatible with the ink (not shown) that is cleaned from the nozzle face 16 or extracted from the nozzles 20 during priming, such as, for example, Teflon® or Nylon®. In another embodiment, the support member 38 is in rolling contact with the ledge surface 28, so that the material of the support member does not have to be one providing for low frictional contact with the ledge surface. For rolling contact, roller bearings 50, shown in dashed line, or cylindrical bearings (not shown) may be mounted on surface 48 of the support member. To accommodate the roller bearings, surface 48 of the support member 38 is optionally recessed at 48A, shown in dashed line in FIG. 6.

In operation, the printer controller (not shown) senses a lack of paper in the printing plane confronting the printhead nozzles, as when one page of recording medium has been printed and prior to the entrance of the next page of recording medium, and automatically causes the priming and cleaning station to traverse or partially traverse across the nozzle face sucking residual ink and other debris, such as paper particles or dust from the nozzle face. The cleaning by vacuum is conducted at one vacuum suction level, while priming is accomplished at a higher suction level. If any or all of the nozzles and channels require priming because of accumulated air therein, the controller increases the suction level and positions the vacuum port of the priming and cleaning station in alignment with the desired one or more nozzles which require priming. Such priming or cleaning could also be accomplished manually by the mere addition of a handle (not shown) on the carriage.

Use of the accurately diced silicon ledge on the coated silicon nozzle face of the printhead to maintain a tight positional control of the spacing of a cleaning and priming station vacuum port from the printhead nozzle face is equally applicable to a carriage mounted, traversing printhead (not shown). In this configuration, however, the printhead ledge and nozzle array are oriented perpendicular to the direction of traverse of the printhead as it moves back and forth across the printing zone. Generally, the traversing direction of the printhead is in the horizontal direction. At a location to one side of the printing zone, the printhead is stopped at a predetermined location and the cleaning and priming station carriage, which moves the support member with the vacuum port, is moved in a direction parallel to and in contact with the diced ledge; the vertical direction. In all other aspects, the operation of the cleaning and priming station for a carriage type ink jet printhead is substantially the same as described above for the fixed, pagewidth printhead, wherein the accurately diced silicon ledge spaces the vacuum port of the cleaning and priming station from the printhead nozzle face and nozzles therein.

Many modifications and variations are apparent from the foregoing description of the invention, and all such modifications and variations are intended to be within the scope of the present invention.

We claim:

1. An ink jet printer for printing ink images on a recording medium by ejecting ink from a printhead in the form of droplets comprising:

a fixed, pagewidth printhead having a length equal to at least the width of recording medium to be printed thereon by the printer and a linear extended array of nozzles located in a planar surface portion of a nozzle-containing face of said printhead, said printhead face being coated by a material that is non-wetting to the ink and having a ledge along one edge thereof, spaced from and parallel to the linear array of nozzles, said ledge having a surface parallel to and spaced a predetermined distance from said surface portion containing the array of nozzles;

a movable cleaning and priming station having a vacuum port for cleaning and priming at least one nozzle in said extended array of nozzles at a time by selectively applying a vacuum to said vacuum port when the vacuum port is selectively positioned to confront said at least one nozzle of said extended array of nozzles, the cleaning and priming station including:

a carriage adapted for movement along and parallel to the extended array of nozzles;

a support member movably mounted in said carriage for movement therewith and having a surface which is resiliently urged toward said surface of the printhead face ledge for moving contact therewith when said carriage is moved relative to the printhead;

a vacuum conduit fixedly attached to said support member for movement therewith and having an open end confronting said nozzles and spaced a predetermined distance from said printhead face, so that the vacuum conduit open end serves as the vacuum port and is maintained a predetermined distance from said extended array of nozzles;

means for moving the carriage along said printhead length, so that the vacuum conduit open end is selectively locatable adjacent at least one nozzle at a time in said extended array; and a vacuum source with means to vary the vacuum being selectively applied to said vacuum conduit, so that selected nozzles may be cleaned and/or primed dependent on the vacuum applied to the vacuum conduit open end.

2. The printer of claim 1, wherein the pagewidth printhead comprises a plurality of fully functional printhead subunits assembled end-to-end on a structural bar.

3. The printer of claim 2, wherein the printhead subunits are obtained by a dicing process which separates said subunits from two aligned and bonded silicon wafers, a first silicon wafer containing a plurality of sets of etched parallel channel grooves and an etched through reservoir recess for each set of channel grooves, and a second silicon wafer containing a plurality of sets of heating elements and driver circuitry for each set of heating elements.

4. The printer of claim 3, wherein said two silicon wafers sandwich a patterned thick film layer therebetween, the patterned thick film layer providing pits for each heating element and bypass recessed for placing the channel grooves into communication with the reservoir recesses.

5. The printer of claim 3, wherein a two step dicing process is used to form offset notches to form the nozzle face with said ledge.

6. The printer of claim 5, wherein said predetermined distance of the ledge surface from the printhead face containing the nozzle array is less than 0.125 mm.

7. The printer of claim 6, wherein the support member of the cleaning and priming station has a surface resiliently urged into sliding contact with the ledge surface.

8. The printer of claim 7, wherein support member surface in sliding contact with the ledge surface has a material thereon to provide minimum frictional forces when the support member moves relative to the printhead ledge.

9. The printer of claim 8, wherein the material for the support member surface is Teflon® or Nylon®.

10. The printer of claim 7, wherein the support member is comprised of a material which provides minimum frictional forces between support member and printhead ledge surface when the support member and printhead ledge surface are moved relative to each other.

11. The printer of claim 6, wherein the support member of the cleaning and priming station has means for providing rolling contact between the support member surface and the printhead ledge surface, and wherein the support member is resiliently urged toward the printhead ledge surface by a spring, so that the means for rolling contact is maintained in contact with the printhead ledge surface.

12. The printer of claim 6, wherein an edge surface of the structural bar is coplanar with the printhead ledge surface, so that the structural bar edge surface is available for moving contact with the support member.

13. The printer of claim 6, wherein means are provided to permit the cleaning and priming station to be moved to one side of the pagewidth printhead out of a printing zone while the pagewidth printhead is printing.

14. The printer of claim 13, wherein the means to permit the cleaning and priming station to be moved outside of the printing zone is a dummy printhead subunit with a ledge and ledge surface in position at one end of the pagewidth printhead on said structural bar, the ledge surface of the dummy printhead being coplanar with the ledge surface of the printhead, so that the support member of the cleaning and priming station may reside in contact with the ledge surface of the dummy printhead subunit while the pagewidth printer is printing, thereby providing a smooth coplanar transition from a position out of printing zone to a position anywhere along the nozzle face of the pagewidth printhead.

* * * * *